US008716686B2

(12) United States Patent
Bardon et al.

(10) Patent No.: US 8,716,686 B2
(45) Date of Patent: May 6, 2014

(54) CANISTER FOR TRANSPORTING AND/OR STORING RADIOACTIVE MATERIALS CONFERRING ENHANCED HEAT TRANSFER

(75) Inventors: Olivier Bardon, Saint Cloud (FR); Guilaume Foussard, Le Mesnil Saint Denis (FR); Stavros Kitsos, St Remy les Chevreuse (FR)

(73) Assignee: TN International, Montigny le Bretonneux (FR)

( * ) Notice: Subject to any disclaimer, the term of this patent is extended or adjusted under 35 U.S.C. 154(b) by 251 days.

(21) Appl. No.: 12/940,666

(22) Filed: Nov. 5, 2010

(65) Prior Publication Data

US 2011/0272603 A1 Nov. 10, 2011

(30) Foreign Application Priority Data

Nov. 10, 2009 (FR) ..... 09 57929

(51) Int. Cl.
*G21F 5/00* (2006.01)
*G21F 1/08* (2006.01)

(52) U.S. Cl.
USPC ..... 250/515.1; 250/55.1; 250/506.1

(58) Field of Classification Search
USPC ..... 250/505.1, 507.1, 515.1, 518.1
See application file for complete search history.

(56) References Cited

U.S. PATENT DOCUMENTS

| | | | | |
|---|---|---|---|---|
| 5,641,970 | A * | 6/1997 | Taniuchi et al. | 250/506.1 |
| 6,195,404 | B1 * | 2/2001 | Lemogne et al. | 376/272 |
| 2006/0219960 | A1 * | 10/2006 | Shimojo et al. | 250/518.1 |
| 2008/0209972 | A1 * | 9/2008 | Funakoshi et al. | 72/273 |
| 2009/0114856 | A1 * | 5/2009 | Shimojo et al. | 250/506.1 |

FOREIGN PATENT DOCUMENTS

| | | |
|---|---|---|
| GB | 1 422 018 | 1/1976 |
| JP | 2007-139677 | 6/2007 |
| JP | 2008-76408 | 4/2008 |

OTHER PUBLICATIONS

Preliminary Search Report for French Application No. 09 57929 dated Jun. 24, 2010.

* cited by examiner

*Primary Examiner* — Nicole Ippolito
(74) *Attorney, Agent, or Firm* — Nixon Peabody LLP

(57) ABSTRACT

A canister for transporting and/or storing radioactive materials, the canister comprising two concentric shells between which is housed a radiological protection device comprising at least a first and a second metal components adjacent along a circumferential direction. According to the invention, the first component is supported against the outer shell and at a distance from the inner shell, whereas the second component is supported against the shell and at a distance from the shell. In addition, the components are in contact with each other along an interface taking, in section along any plane orthogonal to the longitudinal axis and crossing this interface, the form of a straight line segment defining with a radial straight line crossing it at its centre an acute angle (A).

17 Claims, 6 Drawing Sheets

CANISTER FOR TRANSPORTING AND/OR STORING RADIOACTIVE MATERIALS CONFERRING ENHANCED HEAT TRANSFER

CROSS REFERENCE TO RELATED APPLICATIONS OR PRIORITY CLAIM

This application claims priority of French Patent Application No. 09 57929, filed Nov. 10, 2009.

DESCRIPTION

1. Technical Field

The present invention relates to the field of transporting and/or storing radioactive materials, such as nuclear fuel assemblies, fresh or irradiated.

In particular, the invention relates to a canister comprising a radiological protection device laid out between two concentric shells, forming a barrier against gamma radiation.

2. State of the Prior Art

Conventionally, to ensure the transport and/or the storage of nuclear fuel assemblies, storage devices, also known as storage "baskets" or "racks", are used. These storage devices, normally of cylindrical shape and of substantially circular section, have a plurality of adjacent housings each of which is able to receive a nuclear fuel assembly. The storage device is intended to be housed in the cavity of a canister so as to form jointly with it a container for transporting and/or storing nuclear fuel assemblies, in which the nuclear material is confined.

The aforementioned cavity is generally defined by a lateral body extending along a longitudinal direction of the canister, said lateral body comprising for example two concentric metal shells jointly forming an annular space inside which is housed a radiological protection device, in particular to form a barrier against the gamma radiation emitted by the fuel assemblies housed in the cavity.

Conventionally, the radiological protection device is formed by means of several prefabricated components made of lead or one of its alloys, spread around the cavity, in the appropriate annular space defined by the two metal shells.

To do this, each of these components is inserted between the two shells, along a longitudinal insertion direction. Thus, an assembly clearance must be provided to allow such an insertion, said clearance having as consequence a discontinuity of material in the lateral body of the canister, along the radial direction in which are laid out successively the inner shell, the radiological protection components, and the outer shell. The observed discontinuity of material has the effect of a considerable decrease in the thermal conductivity of the lateral body of the canister, implying a low capacity of the latter to dissipate the heat produced by the fuel assemblies.

To minimise the negative impact of the discontinuities of material, the clearances between the radiological protection components and the shells may be reduced by lessening the manufacturing tolerances, but this proves nevertheless to be very costly, and does not in the least enable the discontinuities of material to be eliminated.

Other means may be employed to reduce the loss of thermal efficiency, such as that aiming to inject helium into the empty spaces. However, this technique induces a cost and poses serious problems of operating the canister.

Another solution consists in separating the radiological protection function from that of heat conduction, this then being fulfilled by means of additional fin type components linking the two shells, laid out alternately with the radiological protection components in the annular space. Nevertheless, this further complicates the design of the canister, and moreover necessitates the use of particular techniques to ensure that the fins are indeed in contact with each of the two shells of the lateral body.

SUMMARY OF THE INVENTION

The aim of the invention is thus to remedy, at least partially, the aforementioned drawbacks relative to embodiments of the prior art.

To do this, the object of the invention is a canister for transporting and/or storing radioactive materials, said canister comprising a lateral body extending around a longitudinal axis of said canister, said lateral body forming a cavity for housing the radioactive materials and comprising an inner metal shell and an outer metal shell, the two shells being concentric and forming jointly an annular space inside which is housed a radiological protection device forming a barrier against gamma radiation, said radiological protection device comprising at least one first and one second metal radiological protection components adjacent along a circumferential direction of the canister.

According to the invention, said first component is supported against the outer shell and at a distance from said inner shell, whereas said second component is supported against the inner shell and at a distance from said outer shell. In addition, said first and second components are in contact with each other along an interface taking, in section along any plane orthogonal to the longitudinal axis and crossing this interface, the form of a straight line segment defining with a radial straight line crossing it at its centre an acute angle (A).

The invention thus offers a shrewd design enabling the radiological protection components to conduct heat in a satisfactory manner between the two shells. Indeed, the heat is conducted in a continuous manner, firstly between the inner shell and the second radiological protection component, thanks to the contact between these parts, then through the interface between the first and second components, and finally between the first radiological protection component and the outer shell, again on account of the contact provided between these parts.

Thus, the particular geometry and arrangement of the radiological protection components make it possible to confer to the lateral body of the canister a satisfactory thermal conductivity. The presence of helium or heat conduction fins is thus no longer necessary, which makes it possible to have a canister of simplified design and manufacture.

Moreover, since the first and second radiological protection components are no longer intended, as in the prior art, to come as close as possible to each of the two shells, but each being only in contact with one and at a distance from the other of the two shells, the manufacturing tolerances of said components may be increased. Advantageously an important cost reduction ensues.

Finally, thanks to the inclination of the aforementioned interface, the contact force that is observed between the two components, at this interface, radially constrains each of these two components against its associated shell. Thus, with this design, it is possible to increase the intensity of contact between the radiological protection components and their associated shell, simply by further tightening these components along the circumferential direction, in order to obtain a relative displacement of the first in relation to the second component, along the radial direction. This tightening may for example be achieved, during the manufacture of the canister, by means of tightening means housed in the annular space. The increase in the intensity of these contacts is advantageous in the sense that it ensures better heat conduction. In this respect, it is noted that one and/or the other of the radiological protection components may be coated with a heat conducting layer at the contact interface, in order to improve yet further the heat conduction between these components. This layer is preferably of low thickness, and deformable, for example made of lead or one of its alloys. Naturally, this solution of heat conducting layer may also be adopted at the contacts between the radiological protection components and the shells.

Preferably, said angle (A) is between 30 and 60°, and, even more preferentially, is close to 45°. The interfaces thereby inclined enable a satisfactory radial pinning of the radiological protection components, when they are constrained circumferentially.

Preferably, said interface is flat.

Preferably, the canister comprises at least one first metal radiological protection component as well as two second metal radiological protection components arranged on either side of said first component along the circumferential direction, said first component being in contact with each of the two second components along respectively two interfaces each taking, in section along any plane orthogonal to the longitudinal axis and crossing this interface, the form of a straight line segment defining with a radial straight line crossing it at its centre an acute angle (A), the two straight line segments being respectively supported by straight lines coming closer to each other going radially towards the interior and intercepting between the two radial straight lines.

In this configuration, the first component is put under strain by the two second components, which thus participate jointly in its pinning against the outer shell. Moreover, this first component participates for its part in the pinning of the two second components against the inner shell.

Obviously, a different inclination angle may be adopted for the two interfaces, even if the two angles are preferentially equal.

In an analogous manner, the canister preferably comprises at least one second metal radiological protection component as well as two first metal radiological protection components arranged on either side of said second component along the circumferential direction, said second component being in contact with each of the two first components along respectively two interfaces each taking, in section along any plane orthogonal to the longitudinal axis and crossing said interface, the form of a straight line segment defining with a radial straight line crossing it at its centre an acute angle (A), the two straight line segments being respectively supported by straight lines coming closer to each other going radially towards the exterior and intercepting between the two radial straight lines.

Preferentially, a plurality of first and second components laid out alternately along the circumferential direction, and cooperating in the aforementioned manner, are provided for, namely that each of them is put under strain by its two adjacent components, which participate jointly in its pinning against its associated shell.

Preferably, each first radiological protection component has a section, along any plane orthogonal to the longitudinal axis, of overall trapezium shape, the large base of which is supported against the outer shell and the small base at a distance from the inner shell, each second radiological protection component has a section, along any plane orthogonal to the longitudinal axis, of overall trapezium shape, the large base of which is supported against the inner shell and the small base at a distance from the outer shell, and the faces of the first and second components defining the sides of trapeziums are in two by two contact, so as to form said interfaces.

Nevertheless, shapes other than the trapezium could be envisaged, it being in this respect pointed out that the first components could adopt a shape different to that of the second components, in the same way as different shapes could be adopted within the first/second components. By way of indication, other envisaged shapes are for example the triangle, or the trapezium truncated at the two angles between the large base and the sides.

Preferably, for each trapezium, the large base is intercepted, locally at its centre, orthogonally by a radial straight line.

To facilitate manufacture and to obtain a symmetry in the application of the contact forces, each trapezium is isosceles.

It is noted that the large base of each trapezium is preferably straight, and even more preferentially arc of circle shape of diameter identical to that of the shell surface that it contacts, in order to increase the contact surface between these two components.

Preferably, for each trapezium, the ratio of lengths between the large base and the small base is between 3 and 8. The higher the ratio, the more efficient the heat transfer.

According to a preferred embodiment of the invention, each of said plurality of first and second components is maintained only by contacts in the annular space. This implies, in particular, that no additional means of fixation are added either between a protection component and its associated shell, or between two directly consecutive protection components. The design thus enables these components to maintain each other mutually by contact, by means also of the shells. This possibility is also offered for protection components of different shape to that of the trapezium.

The canister may then comprise tightening means housed in said annular space, making it possible to constrain said plurality of first and second components along the circumferential direction, and thus cause the pinning of these components radially, against their associated shell.

Preferably, each of said plurality of first and second components takes the form of a prism with trapezoidal base.

According to another preferred embodiment of the invention, each of said plurality of first components or each of said plurality of second components is assembled fixedly to its associated shell, for example by gudgeons/nuts or equivalent means, and each of the plurality of other components is maintained only by contacts in the annular space, between its two adjacent components fixed to their shell.

To facilitate the assembly of such a canister, each of said plurality of components assembled fixedly to its associated shell has a section reducing in a given direction of the longitudinal direction of the canister, and each of the plurality of other components has a section increasing in said given direction of the longitudinal direction. Here, the intensity of the contacts is thus dependent on the relative longitudinal position between the components. Consequently, during the insertion of one of the protection components by longitudinal sliding between its two associated fixed protection components, the contacts between the components, once established, have an intensity that increases as the insertion is continued.

Finally, another object of the invention is a method for producing a canister as described above, in which each first and second metal radiological protection components are inserted into said annular space, then a tightening is carried out making it possible to constrain said components along the circumferential direction.

Other advantages and characteristics of the invention will become clear in the detailed non limitative description given hereafter.

BRIEF DESCRIPTION OF DRAWINGS

This description will be made in reference to the appended drawings, among which.

DETAILED DESCRIPTION OF PREFERRED EMBODIMENTS

Figure 1:
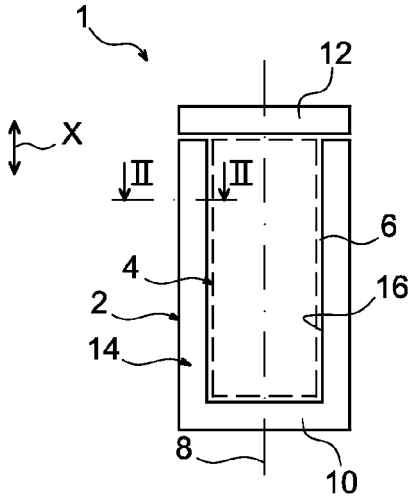
FIG. 1 represents a schematic view of a container for transporting and/or storing nuclear fuel assemblies, comprising a canister according to a first preferred embodiment of the present invention, only represented roughly.

Firstly with reference to FIG. 1, a container 1 for transporting and/or storing nuclear fuel assemblies may be seen. It is in this respect recalled that the invention is in no way limited to the transport/storage of this type of nuclear material.

The container 1 overall comprises a canister 2, object of the present invention, inside of which is a storage device 4, also known as storage basket. The device 4 is provided to be placed in a cavity for housing 6 the canister 2, as shown schematically in FIG. 1, in which it is also possible to perceive the longitudinal axis 8 of this canister, merged with the longitudinal axes of the storage device and the housing cavity.

Throughout the description, the term "longitudinal" must be understood as parallel to the longitudinal axis 8 and to the longitudinal direction X of the canister, and the term "circumferential" must be understood as orthogonal to this same longitudinal axis 8, as well as to a transversal direction of the canister.

In a conventional manner and by way of reminder, it is noted that the storage device 4 comprises a plurality of adjacent housings arranged parallel to the axis 8, the latter each being able to receive at least one fuel assembly of square or rectangular section, and preferably only one. The container 1 and this device 4 have been shown in a vertical position of loading/unloading the fuel assemblies, different to the horizontal/lying down position normally adopted during the transport of the assemblies.

Generally speaking, the canister 2 essentially has a bottom 10 on which the device 4 is intended to lie in a vertical position, a lid 12, and a lateral body 14 extending around and along the longitudinal axis 8, this body 14 defining a canister opening intended to allow the basket to penetrate into the housing cavity 6, and to be then sealed by the lid 12.

It is thus this lateral body 14 that defines the housing cavity 6, by means of a lateral inner surface 16 of substantially cylindrical shape and of circular section, and of axis merged with the axis 8.

The bottom 10, which defines the bottom of the cavity 6 open at the lid 12, may be formed from a single part with part at least of the lateral body 14, without going beyond the scope of the invention.

Figure 2:
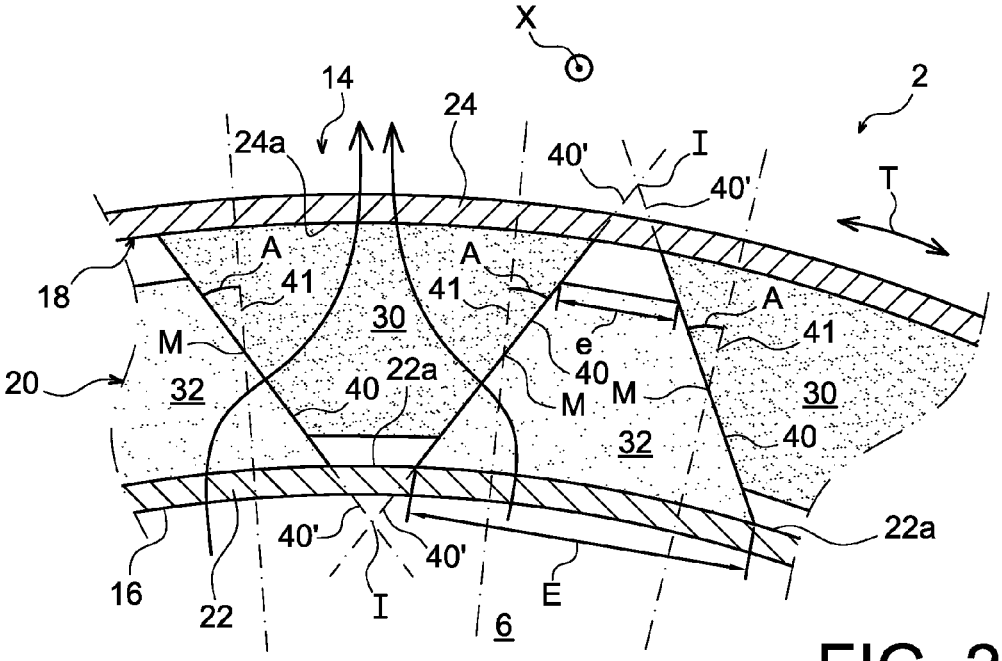
FIG. 2 represents a more detailed cross sectional view of a part of the canister, taken along the line II-II of FIG. 1.

With reference now to FIG. 2, it is possible to perceive in a detailed manner part of the lateral body 14, which has firstly two concentric metal shells forming jointly an annular space 18 centred on the longitudinal axis of the canister (not visible in this figure), this space 18 housing a radiological protection device 20 specific to the present invention. The shells 22, 24 are for example made of steel.

This protection device 20 is in particular designed to form a barrier against the gamma radiation emitted by the irradiated fuel assemblies housed in the cavity 6. Thus, it is housed between the internal shell 22, the inner surface of which corresponds to the inner lateral surface 16 of the cavity 6, and the outer shell 24.

As may be seen in FIG. 2, in this first preferred embodiment of the present invention, the protective device 20 comprises a plurality of first and second radiological protection components, respectively referenced 30 and 32, which are laid out alternately along the circumferential direction T, also known as tangential direction. The number of these components 30, 32 may be several tens.

The first and second components 30, 32 are metal, preferably blocks made of lead or cast iron or one of their alloys, this type of material making it possible to ensure both radiological protection against gamma radiation, and satisfactory thermal conductivity.

Each of the first and second components 30, 32 has a substantially trapezoidal section, which, in this first preferred embodiment, is preferentially constant over its whole length. Indeed, each component here takes the form of a straight prism of axis parallel to the axis 8, with trapezoidal base, housed between the two shells 22, 24, and extending longitudinally over the length of the cavity 6. In addition, the trapezoidal section takes the overall form of an isosceles trapezium.

As regards each first component 30, the face that defines the large base is supported, and more preferentially is in direct contact, against the inner surface 24*a* of the outer shell 24. This contact is preferentially a surface contact, over the whole surface of the prism that is facing the inner surface 24*a*. To do this, the large base adopts preferentially a convex arc of circle shape of diameter similar or identical to that of the inner surface 24*a*, and of same centre, even though a large straight base could be envisaged, without going beyond the scope of the invention.

Moreover, the small base is at a distance from the outer surface 22*a* of the inner shell 22, a consequent clearance could be provided for, for example greater than 5 mm, or even much more. Generally speaking, the aforementioned radial clearance represents between 1/30 and 1/10 of the radial thickness of the space 18.

Conversely, each second component 32 has its face defining the large base supported, and more preferentially in direct contact, against the outer surface 22*a* of the inner shell 22. This contact is preferentially a surface contact, over the whole surface of the prism that is facing the outer surface 22*a*. To do this, the large base here adopts a concave arc of circle shape of diameter similar or identical to that of the outer surface 22*a*, and of same centre, even though a large straight base could also be envisaged.

Moreover, the small base is at a distance from the inner surface 24*a* of the inner shell 22, a consequent clearance could be provided for, for example greater than 5 mm, or even much more. Here also, the aforementioned radial clearance represents more generally between 1/30 and 1/10 of the radial thickness of the space 18.

The faces of the first and second components 30, 32 which define the small bases of the trapeziums may have, in transversal section, various shapes, for example straight or instead arc of circle.

The faces of the blocks 30, 32 which define the sides of the trapeziums are in two by two contact, while preferentially forming flat interfaces 40. More precisely, as shown in FIG. 2, each contact interface 40 adopts, in section along any plane orthogonal to the longitudinal axis 8 and crossing this interface, the shape of a straight line segment defining, with a radial straight line 41 crossing it at its centre M, an acute angle A. This acute angle A, which is thus between the values of 0° and 90°, excluded from the interval, is preferably between 30 and 60°, and even more preferentially of the order of 45°. The inclination direction of the aforementioned straight line segment is such that the radial straight line 41 extends firstly through the first component 30 starting from the segment and going radially towards the exterior, and extends firstly through the second component 32 starting from the segment and going radially towards the interior. In other words, the straight line segment 40 extends radially towards the interior from its centre while being offset circumferentially from the radial straight line 41 along a circumferential offset direction corresponding to that of the first component 30 in relation to the second component 32. By way of example, in FIG. 2, the first component 30 the furthest left is offset circumferentially from the second component 32 the furthest left along the clockwise direction. In addition, it is along this same clockwise direction that is offset the radially inner part of the segment 40 in relation to the radial straight line 41.

At each first component 30, the two interfaces 40 defined by it thus each take the shape of a straight line segment inclined from the acute angle A in relation to its associated radial straight line 41. In addition, on account of the trapezoidal section, these two straight line segments 40 are respectively supported by two straight lines 40' coming closer to each other going radially towards the interior, and intercepting at a point I situated between the two radial straight lines 41, 41 crossing these two same segments at their centre. In other words, each segment 40 forms part of the straight line 40' that supports it. In an analogous manner, at each second component 32, the two interfaces 40 defined by it thus each take the shape of a straight line segment inclined from the acute angle A in relation to its associated radial straight line 41. In addition, also on account of the trapezoidal section, these two straight line segments 40 are respectively supported by two straight lines 40' coming closer to each other going radially towards the exterior, and intercepting at a point I situated between the two radial straight lines 41, 41 crossing these two same segments at their centre.

Moreover, for each component 30, 32, the ratio of lengths between the large base E and the small base e is between 3 and 8.

With such a configuration, the heat released by the assemblies is conducted in a continuous manner between the two shells 22, 24, which confers satisfactory thermal conductivity to the lateral body. As shown schematically by the arrows of FIG. 2, the heat is firstly conducted between the inner shell 22 and the faces defining the large bases of the second components 32, then by the contact interfaces 40 between the first and second components 30, 32, and finally between the faces defining the large bases of the first components 30 and the outer shell 24. One of the main advantages of this solution lies in continuous privileged heat conduction paths being obtained between the two shells, with components 30, 32 of simple shape, each in contact with only one of these two shells. This latter point implies that they may be manufactured with high tolerances, reducing their production cost.

In the first preferred embodiment, each of the components 30, 32 is thus maintained uniquely by contacts in the annular space 18, each of them being pinned against one of the shells and against its two adjacent protection components.

The components 30, 32 may thus be inserted longitudinally one after the other into the space 18, each component next being placed in contact with the last component previously inserted, at one of its lateral faces defining one side of a trapezium, its other lateral face being for its part intended to serve as support contact for the next component to be inserted.

The plurality of components 30, 32 may extend in a continuous manner over 360°. Nevertheless, to avoid any difficulties of assembly of the final radiological protection component, said plurality of components 30, 32 may extend over substantially less than 360° in order to leave an angular sector dedicated to the positioning of circumferential tightening means in the space 18.

Figure 3:
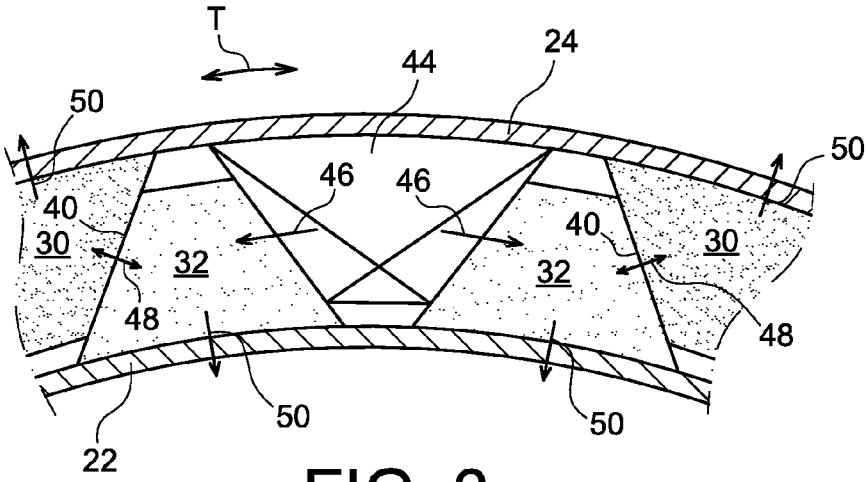
FIG. 3 represents a view similar to that of the preceding figure, in which has been represented schematically circumferential tightening means of the radiological protection components.

In this respect, a circumferential tightening device 44 is shown schematically in FIG. 3, placed between the two end components of said plurality of components forming an angular sector close to 360°. This device, which may be of any design considered appropriate by those skilled in the art, makes it possible to constrain the components 30, 32 along the circumferential direction, as is schematically shown by the arrows 46. This placing under circumferential constraint of said plurality of components generates, between each pair of any two adjacent components 30, 32, an increase in the contact force that is exerted at the faces defining the sides of trapeziums, this force oriented orthogonally to the interface 40 being represented by arrows 48 in FIG. 3.

Thanks to its inclination in relation to the circumferential direction T, the force 48 makes it possible to constrain each of the two components 30, 32 against its associated shell, as has been shown schematically by the arrows 50. In other words, one of the two components 30, 32 exerts on the other a force pinning it against its associated shell, and vice versa. Thus, it is possible to increase the intensity of contact between the components 30, 32 and their associated shell by carrying out a circumferential tightening by means of the device 44, this tightening obviously also bringing about an increase in the intensity of contact between the lateral faces of the components 30, 32 defining the sides of trapeziums. The increase in the intensity of these contacts is advantageous in the sense that it ensures better heat conduction.

Figure 4:
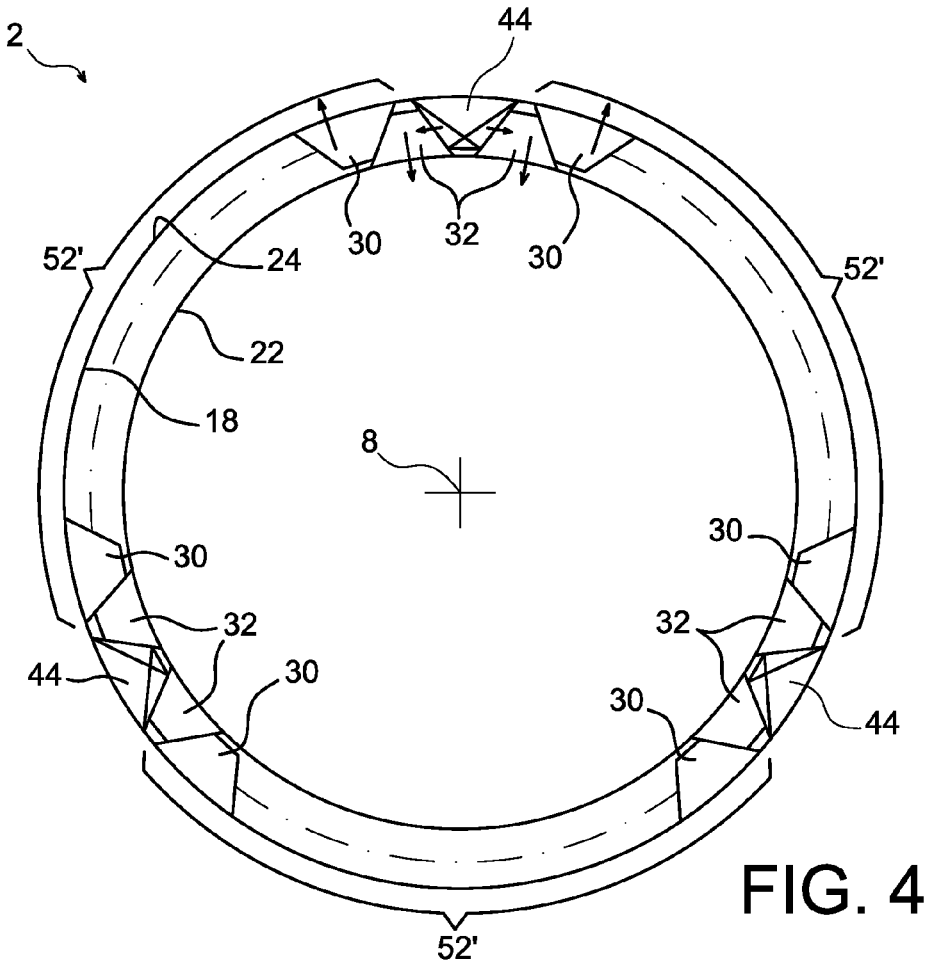
FIG. 4 represents a schematic cross sectional view showing a canister equipped with several circumferential tightening devices, spaced apart from each other in the annular space between the shells of the canister lateral body.

In another envisaged configuration, only shown schematically in FIG. 4, several circumferential tightening devices 44 are provided for, for example three arranged at 120°. Whatever the number of these devices 44, two of them directly consecutive along the circumferential direction delimit between them a plurality of components 30, 32 that they constrain circumferentially. Thus, in the example shown in FIG. 4, three separate assemblies 52' are provided, each forming a plurality of components 30, 32 slid into the annular space 18, as well as three tightening devices 44 each participating in bringing under circumferential pressure two adjacent assemblies 52'.

In the case where several tightening devices 44 are provided for in the annular space 18, at least one of them may then take the form of a component fixed to one of the shells 22, 24, of identical or similar shape to that of the components 30, 32. Even if this device does not comprise means enabling it to extend circumferentially, it fulfils all the same a tightening function in combination with each tightening device directly consecutive to it, by constituting a pressure stop for the plurality of components with which it is associated.

In such a configuration, the fixed component may moreover fulfill a function of angular indexation of the components 30, 32, and also serve as fixed support capable of maintaining in position the first component 30, 32 after it has been slid into the annular space 18, during the manufacture of the canister.

Figure 5:
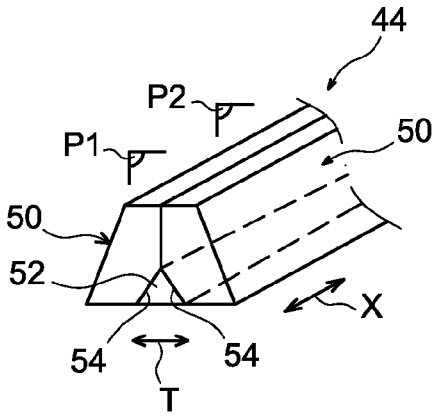
FIG. 5 represents a partial perspective view showing an example of embodiment of a circumferential tightening device.
Figure 6:
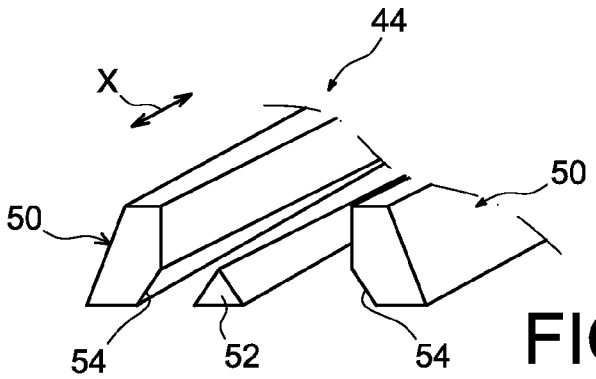
FIG. 6 represents an exploded view of that shown in the preceding figure.
Figure 7A:
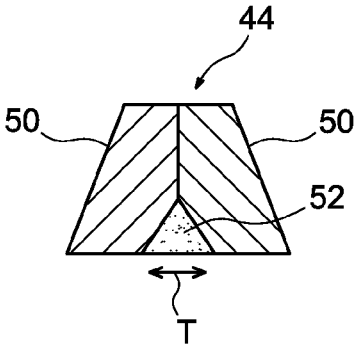
FIGS. 7*a* and 7*b* represent sectional views taken along the planes P1 and P2 of FIG. 5, respectively.
Figure 7B:
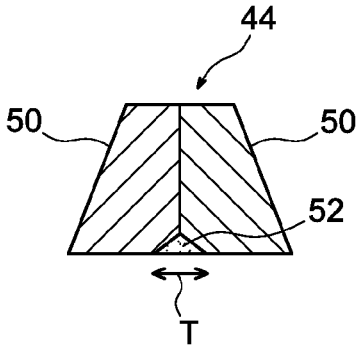
Figure 8:
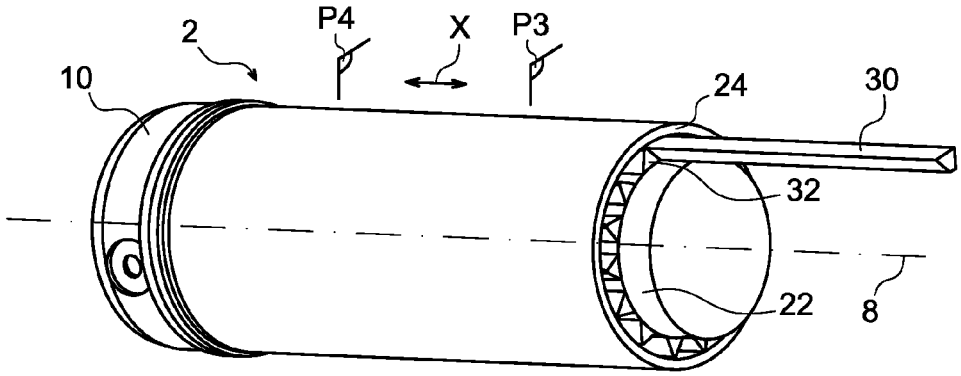
FIG. 8 represents a perspective view of a container for transporting and/or storing nuclear fuel assemblies, comprising a canister according to a second preferred embodiment of the present invention.
Figure 9:
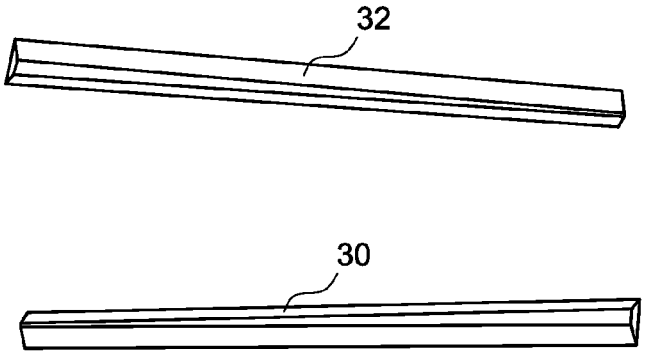
FIG. 9 represents a perspective view of a first radiological protection component and that of a second radiological protection component equipping the canister shown in the preceding figure.

With reference to FIGS. 5 to 7, an example may be perceived of an embodiment of a circumferential tightening device 44, capable of extending in this direction in order to constrain said plurality of components 30, 32. It adopts a general shape identical or similar to that of the components 30, 32 by its shape of overall isosceles trapezoidal section, but, unlike the latter preferably made all in one block, it is conceived of three separate parts. Indeed, it comprises firstly two lateral parts 50 each comprising one face intended to form one of the sides of the trapezium, these two faces being intended to contact the two components placed on either side of this device 44. In this respect, if the tightening device 44 takes the form of a first component 30, it then contacts the two second components 32 that are directly adjacent to it in the circumferential direction, and inversely. These parts 50 are symmetrical and define jointly a face intended to form the small base of the trapezium. They each also comprise one face intended to form a portion of the large base of the trapezium, this large base being completed, at its centre, by the base of a tightening component 52 of triangular section, intended to be inserted between the two lateral parts 50. This tightening component 52 is tapering, namely it has a triangular section that reduces along the longitudinal direction X, as may be seen in FIGS. 7*a* and 7*b*. If the base of this tightening component 52 is provided to complete the large base of the trapezium, its two flat lateral faces are for their part intended to place under pressure two flat supporting surfaces 54 at a distance and facing, belonging respectively to the two lateral parts 50.

In addition, the inclinations of the lateral faces of the tightening component 52 and the supporting surfaces 54 are provided to obtain simultaneously two surface contacts, preferably flat contacts.

The device 44 operates in the following manner. Firstly, the two lateral parts 50 are inserted into the inner space defined by the shells, between two components 30, 32. Then, it is the tightening component 52 that is slid longitudinally between the two supporting surfaces 54, until flat contacts are obtained. The continuation of the longitudinal displacement of the tightening component 52 in relation to the parts 50 leads to them being moved away from each other along the circumferential direction T, and thus to constrain in this same direction the plurality of radiological protection components 30, 32, that are then pinned mutually against their associated shell, on account of the relative radial displacement between these components.

With reference to FIGS. 8 to 10*b*, a canister 2 according to a second preferred embodiment of the invention may be perceived.

It is distinguished from the first, on the one hand, by the fact that the second components 32 are not uniquely in contact with the inner shell 22, but assembled fixedly to it, for example by gudgeons integral with the shell and nuts (not represented), or by any other means, such as welding. On the other hand, each first component 30 remains maintained only by contacts in the annular space 18, between its two second adjacent components 32 fixed to the shell 22, and the outer shell 24.

Figure 10A:
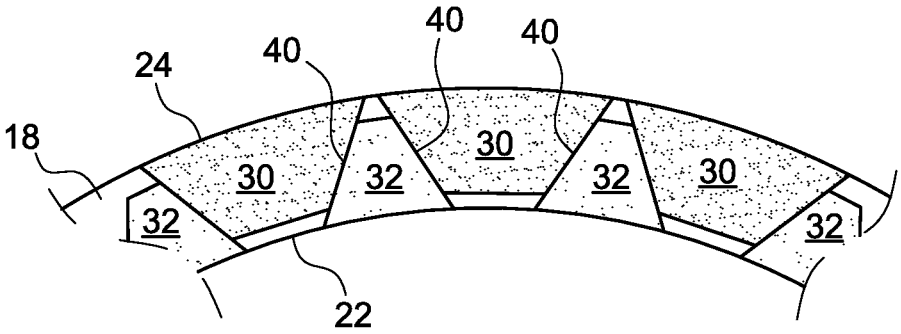
FIGS. 10*a* and 10*b* represent sectional views taken along the planes P3 and P4 of FIG. 8, respectively.
Figure 10B:
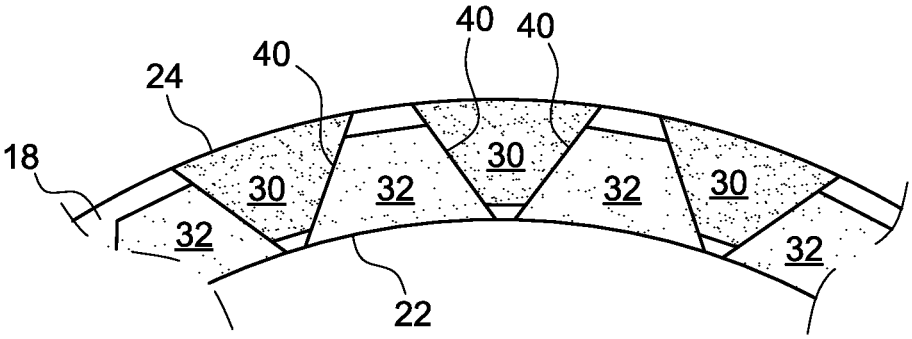

Moreover, another difference lies in the fact that the second components 32 each have a trapezoidal section reducing in a given direction of the longitudinal direction X, and that, conversely, the first components 30 each have a trapezoidal section increasing in said given direction, this being most clearly visible in FIGS. 10*a* and 10*b*.

To ensure the manufacture of the canister, each first component 30 is thus slid longitudinally between its two second associated fixed components 32 and between the two shells 22, 24, until flat contacts are obtained between the lateral faces of the components 30, 32 defining the sides of trapeziums, and a flat contact is obtained between the face of the component 30 defining the large base and the outer shell. Just as in the first preferred embodiment, the lateral faces of the components 30, 32, defining the sides of trapeziums, are flat.

The continuation of the longitudinal displacement of the first component 30 in relation to the two components 32 leads to increasing the intensity of the contacts, and thus to reinforcing the thermal conductivity.

To ensure satisfactory contact forces, on the one hand, and to obtain a jamming effect of the component 30 between the components 32 and the outer shell, on the other hand, the variation in trapezoidal section along the longitudinal direction is such that the lateral faces of the components 30 and 32 are inclined in relation to the longitudinal axis by a value between 1 and 10°. Moreover, it is noted that just the own weight of the component 30 may suffice to obtain the requisite contact forces.

Figure 11:
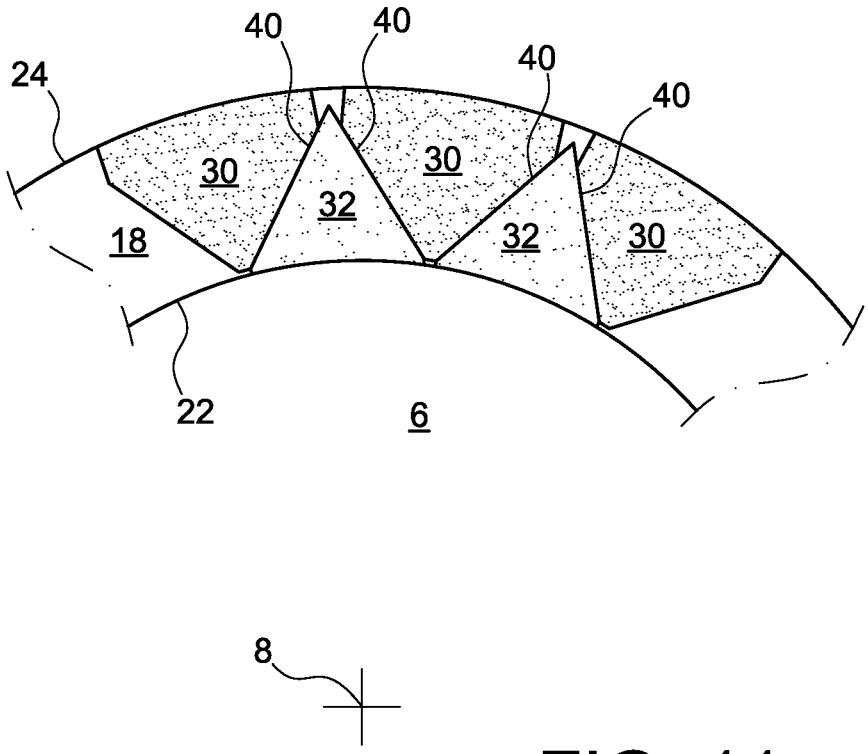
FIG. 11 represents a similar view to that of FIG. 2, with the canister being in the form of a third preferred embodiment of the present invention.

Finally, the third embodiment shown in FIG. 11 differs from the preceding embodiments in that the first components 30 have a transversal section of overall truncated trapezium shape at the two angles between the large base and the sides, and in that the second components 32 have a transversal section of overall triangle shape. The other characteristics are identical or similar, in particular as regards the inclination of the contact interfaces 40.

Obviously, various modifications may be made by those skilled in the art to the invention that has just been described, uniquely by way of non-limiting examples.

The invention claimed is:

1. Canister for transporting and/or storing radioactive materials, said canister comprising a lateral body extending around a longitudinal axis of said canister, said lateral body forming a cavity for housing radioactive materials and comprising an inner metal shell and an outer metal shell, the two shells being concentric and forming jointly an annular space inside which is housed a radiological protection device forming a barrier against gamma radiation, said radiological protection device comprising at least one first and one second metal radiological protection components adjacent along a circumferential direction of the canister, characterised in that said first component is supported against the outer shell and at a distance from said inner shell, whereas said second component is supported against the inner shell and at a distance from said outer shell, and in that said first and second components are in contact with each other along an interface taking, in section along any plane orthogonal to the longitudinal axis and crossing this interface, the form of a straight line segment defining with a radial straight line crossing it at its centre an acute angle (A), wherein the first and second components are distinct, and wherein the contact force between said first and second components at the interface radially constrains the first and second components against the outer shell and inner shell, respectively.

2. Canister according to claim 1, characterised in that said angle (A) is between 30 and 60°.

3. Canister according to claim 1, characterised in that said interface is flat.

4. Canister according to claim 1, characterised in that it comprises at least one first metal radiological protection component as well as two second metal radiological protection components arranged on either side of said first component along the circumferential direction, said first component being in contact with each of the two second components along respectively two interfaces each taking, in section along any plane orthogonal to the longitudinal axis and crossing this interface, the shape of a straight line segment defining with a radial straight line crossing it at its centre an acute angle (A), the two straight line segments being respectively supported by two straight lines coming closer to each other going radially towards the interior and intercepting between the two radial straight lines.

5. Canister according to claim 1, characterised in that it comprises at least one second metal radiological protection component as well as two first metal radiological protection components arranged on either side of said second component along the circumferential direction, said second component being in contact with each of the two first components along respectively two interfaces each taking, in section along any plane orthogonal to the longitudinal axis and crossing this interface, the shape of a straight line segment defining with a radial straight line crossing it at its centre an acute angle, the two straight line segments being respectively supported by two straight lines coming closer to each other going radially towards the exterior and intercepting between the two radial straight lines.

6. Canister according to claim 1, characterised in that it comprises a plurality of first and second metal radiological protection components, laid out alternately along the circumferential direction.

7. Canister according to claim 6, characterised in that each first radiological protection component has a section, along any plane orthogonal to the longitudinal axis, of overall trapezium shape, the large base of which is supported against the outer shell and the small base at a distance from the inner shell, in that each second radiological protection component has a section, along any plane orthogonal to the longitudinal axis, of overall trapezium shape, the large base of which is supported against the inner shell and the small base at a distance from the outer shell, and in that the faces of the first and second components defining the sides of trapeziums are in two by two contact, so as to form said interfaces.

8. Canister according to claim 7, characterised in that for each trapezium, the large base is intercepted, locally at its centre, orthogonally by a radial straight line.

9. Canister according to claim 7, characterised in that each trapezium is isosceles.

10. Canister according to claim 7, characterised in that the large base of each trapezium is straight or arc of circle shape of diameter identical to that of the shell surface that it contacts.

11. Canister according to claim 7, characterised in that for each trapezium, the ratio of lengths between the large base and the small base is between 3 and 8.

12. Canister according to claim 6, characterised in that each of said plurality of first and second components is maintained only by contacts in the annular space.

13. Canister according to claim 12, characterised in that it comprises tightening means housed in said annular space, making it possible to constrain said plurality of first and second components along the circumferential direction.

14. Canister according to claim 12, characterised in that each of said plurality of first and second components takes the form of a prism with trapezoidal base.

15. Canister according to claim 6, characterised in that each of said plurality of first components or each of said plurality of second components is assembled fixedly to its associated shell, and in that each of the plurality of other components is maintained only by contacts in the annular space.

16. Canister according to claim 15, characterised in that each of the plurality of components assembled fixedly to its associated shell has a section reducing in a given direction of the longitudinal direction (X) of the canister, and in that each of the plurality of other components has a section increasing in said given direction of the longitudinal direction.

17. Method for producing a canister according to claim 1, wherein each first and second metal radiological protection component are inserted into said annular space, then a tightening is carried out making it possible to constrain these components along the circumferential direction.

* * * * *